US005876151A

United States Patent [19]

Brown, III et al.

[11] Patent Number: 5,876,151

[45] Date of Patent: Mar. 2, 1999

[54] FRAME AND METHOD FOR INSTALLING VISCOUS DRAG AND NON-LAMINAR FLOW COMPONENTS OF AN UNDERWATER EROSION CONTROL SYSTEM

[75] Inventors: Fletcher Webster Brown, III; Steve Joe Pick; Joseph Grenier Browning; Arno James Moore; Carlos Munoz, all of Polson, Mont.

[73] Assignee: Marine Environmental Solutions, L.L.C., Calverton, Md.

[21] Appl. No.: 665,257

[22] Filed: Jun. 17, 1996

[51] Int. Cl.[6] ..... E02B 3/04

[52] U.S. Cl. ..... 405/52; 405/21; 405/25; 405/28

[58] Field of Search ..... 405/21, 25, 28, 405/32, 52, 73, 23

[56] References Cited

U.S. PATENT DOCUMENTS

| | | | |
|---|---|---|---|
| 812,045 | 2/1906 | Kellner | 405/32 |
| 4,437,786 | 3/1984 | Morrisroe | 405/24 |
| 4,490,071 | 12/1984 | Morrisroe | 405/24 |
| 4,534,675 | 8/1985 | Morrisroe | 405/24 |
| 4,641,997 | 2/1987 | Lauer et al. | 405/24 |
| 4,657,432 | 4/1987 | Rentrop et al. | 405/24 |
| 4,710,057 | 12/1987 | Laier | 405/30 |
| 4,722,639 | 2/1988 | Alsop | 405/25 |
| 4,738,063 | 4/1988 | Alsop | 52/163 |
| 5,007,766 | 4/1991 | Freed et al. | 405/24 |
| 5,056,956 | 10/1991 | Nicholson | 405/17 |
| 5,102,257 | 4/1992 | Creter | 405/25 |
| 5,113,792 | 5/1992 | Jones et al. | 405/25 |
| 5,141,359 | 8/1992 | Klockner | 405/26 |
| 5,158,395 | 10/1992 | Holmberg | 405/21 |
| 5,176,468 | 1/1993 | Poole | 405/23 |
| 5,176,469 | 1/1993 | Alsop | 405/24 |
| 5,257,878 | 11/1993 | Peterson | 405/15 |
| 5,259,696 | 11/1993 | Beardsley | 405/73 |
| 5,364,206 | 11/1994 | Marienfeld | 405/21 X |
| 5,575,584 | 11/1996 | Alsop | 405/24 |

FOREIGN PATENT DOCUMENTS

| | | |
|---|---|---|
| 2078669 | 11/1971 | France . |
| 3439069 | 5/1986 | Germany . |
| 7710671 | 9/1977 | Netherlands . |
| 789795 | 1/1958 | United Kingdom . |
| 8404118 | 10/1984 | WIPO . |
| 8503539 | 8/1985 | WIPO . |
| 8805842 | 8/1988 | WIPO . |
| 9010113 | 9/1990 | WIPO . |

*Primary Examiner*—Tamara L. Graysay
*Assistant Examiner*—Tara L. Mayo
*Attorney, Agent, or Firm*—Dickstein Shapiro Morin & Oshinsky LLP

[57] ABSTRACT

An underwater erosion control system that has viscous drag elements for increasing the effect of viscous drag and disrupting laminar flow on the water current has a frame that includes two longitudinal supports that extend along the length of the underwater erosion control system near its bottom portion. The longitudinal supports extend at opposite sides of the viscous drag elements. A plurality of rungs traverse the longitudinal supports and are spaced some distance apart from each other. The viscous drag elements may be panels secured to the rungs along their retaining portion. Apertures are formed within the retaining portion of the panels and are used to retain the panels from lateral movement by passing an inner support through the apertures parallel to the longitudinal supports. The frame may be flexible or rigid. A novel installation frame and a method for installing the rigid frame embodiment also are disclosed.

25 Claims, 5 Drawing Sheets

FRAME AND METHOD FOR INSTALLING VISCOUS DRAG AND NON-LAMINAR FLOW COMPONENTS OF AN UNDERWATER EROSION CONTROL SYSTEM

BACKGROUND OF THE INVENTION

1. Field of the Invention

This invention relates generally to underwater erosion control systems, and more particularly, to a frame for supporting and anchoring an underwater erosion control system and to a method for installing the system.

2. Description of the Related Art

Erosion prevention and control systems are useful for minimizing erosion around underwater structures, including pipes, pilings, bridges and cables, that rely on the seabed for support and also for minimizing coastal shoreline and beach erosion. Methods and devices for preventing underwater bed and shoreline erosion are known. Some of these devices, such as breakwaters and groynes, are effective in minimizing shoreline erosion and are generally constructed from rock, concrete, rubble mounds and other hard body materials. Other devices, primarily used for erosion control on seabed structures, operate by increasing viscous drag on the underwater current, thereby reducing the velocity of the current and of the particulate transported by the current. This causes some of the particulate to settle out of the current and to be deposited in or around the erosion control system. The precipitated particles form a berm in and around the erosion control system. Typical of those devices that increase viscous drag on the current are buoyant frond elements or artificial seaweed or some other viscous drag element. The viscous drag elements are generally secured to the seabed or riverbed via some type of anchor line.

An example of a viscous drag type of underwater erosion control system using anchor lines is shown in U.S. Pat. No. 5,176,469 to Alsop. This system comprises a continuous sequence of buoyant fronds arranged side by side to form a frond line. The frond line is folded back and forth to form an array of fronds, and the successive folded sections of the frond line have aligned openings threaded by anchor lines. The anchor lines secure the array to the sea floor.

A problem with the above system is that the anchor lines do not provide a sufficient amount of structure to maintain the fronds or viscous drag elements in a desired relationship to one another. Additionally, the water currents cause a substantial amount of stress that may tear the openings through which the anchor lines are threaded. Further, anchor lines alone are insufficient to hold the fronds or viscous drag elements in contact with the sea floor, causing adverse effects, including sediment loss due to scour produced by the gap between the sea floor and the viscous drag elements. This problem becomes more severe as the buoyancy of the material used for the fronds or viscous drag elements is increased.

As the relative buoyancy of materials used to construct viscous drag elements increases, the amount of disruption to laminar flow also increases, as does the ability of the material to remain vertical when installed in the water. These factors lead to the enhanced ability to build higher berms of precipitated particles. For coastal shoreline applications it is essential to have high berms which will form submerged, wide-crested breakwaters which, optimally, reach a height of 80% of the depth of the water.

In existing systems, highly buoyant drag elements do not remain in contact with, or in close proximity to, the sea floor preventing the formation of a berm. Thus, these systems cannot be used in coastal shoreline erosion prevention applications.

Therefore, a need exists for a frame and anchoring structure that secures and maintains the viscous drag elements, e.g., panels of highly buoyant material, fronds, or artificial seaweed, in a desired relationship to each other and the sea floor and more uniformly distributes forces from the water current throughout the underwater erosion control system. Where highly buoyant viscous drag elements are required, a need exists for a frame that maintains the erosion control system substantially in contact with the sea floor to allow the formation of a berm of significant height for use as a submerged breakwater in coastal shoreline erosion control applications.

SUMMARY OF THE INVENTION

Accordingly, it is an object of the present invention to provide a structure that maintains the elements that induce non-laminar flow and viscous drag in an underwater erosion control system in a desired relationship to one another.

It is an additional object of the present invention to provide a structure that uniformly distributes forces from the water current evenly throughout an underwater erosion control system.

It is another object of the present invention to provide a structure that secures the viscous drag elements of an underwater erosion control system in contact with the underwater surface or bed.

It is another object of the present invention to provide an apparatus for use in installing an underwater erosion control system.

It is yet another object of the present invention to provide a method for installing an underwater erosion control system.

In one embodiment of the present invention, a flexible apparatus is provided for supporting viscous drag elements in an underwater erosion control system. The apparatus comprises two longitudinal supports that extend lengthwise along the system on opposite sides of the viscous drag elements. The longitudinal supports are substantially parallel to each other. A plurality of cross supports in the form of rungs of a ladder are provided for securing the viscous drag elements substantially perpendicular to the longitudinal supports. The apparatus may include an inner support that is substantially parallel to the longitudinal supports and also secures the viscous drag elements. The apparatus also may include means for anchoring the longitudinal supports. The longitudinal supports may be made of a flexible material, such as polyester webbing. Similarly, the rungs may be made of a flexible material, such as woven polyester fiber bands or polypropylene rope.

The viscous drag elements used in the present invention may be in the form of panels of buoyant material. Each panel may have a retaining portion with at least one aperture formed therein for receiving an inner support.

The rungs used for securing the viscous drag elements may be discrete and not directly connected to each other. Alternatively, the rungs may be continuous and traverse back and forth between the longitudinal supports in a zigzag pattern. The rungs also may form a pattern wherein alternating rungs are substantially parallel.

The present invention also provides a rigid apparatus for supporting viscous drag elements in an underwater erosion control system. The apparatus comprises two substantially parallel end supports and two longitudinal supports that extend lengthwise along the system on opposite sides of the panels. The longitudinal supports are substantially parallel to each other and are attached to the end supports to form a substantially rectangular or square frame. A plurality of rungs secure the viscous drag elements. The rungs are transverse to, and retained by, the longitudinal supports. The apparatus may further include at least one inner support that is substantially parallel to the longitudinal supports and is positioned over the plurality of rungs. The apparatus also may include at least one support for the inner support that is attached to the longitudinal supports. The longitudinal supports and the end supports may be made of a rigid material, such as cold-rolled steel. The rungs may be made of a rigid material, such as carbon steel tubing.

The viscous drag elements may have in the retaining portion at least one aperture. The system also may include at least one inner support that extends substantially parallel to the longitudinal supports and passes through the aperture of the panels. The inner support may be positioned over the plurality of rungs. The system also may have at least one support for the inner support, which is attached to the longitudinal supports.

The present invention also includes an installation frame for use in installing an underwater erosion control system that has a rigid frame, a plurality of viscous drag elements and an anchor assembly. The installation frame includes a first level for engaging the rigid frame. The first level and a second level, mounted above the first level, together define a cavity for receiving the plurality of viscous drag elements. The second level also supports a first deck for supporting ballast. A third level, mounted above the second level, supports a second deck that has mounted thereon a means for setting and tensioning the anchor system.

Finally, the present invention includes a method for installing an underwater erosion control system. The method includes the steps of providing a base frame and placing a rigid mat system, including a rigid frame and a plurality of viscous drag elements attached thereto, on the base frame for alignment purposes. An installation frame is then placed on the rigid mat system. The rigid mat system is then releasably attached to the installation frame. The combination of the rigid mat system and the installation frame is then transported to the underwater surface or sea floor. The rigid mat system is anchored to the sea floor and the installation frame is released leaving the rigid mat system anchored to the sea floor.

DETAILED DESCRIPTION OF THE PREFERRED EMBODIMENT

The underwater erosion control system of the present invention includes a flexible frame embodiment and a rigid frame embodiment. Generally speaking, the flexible frame is more useful in applications that: (1) do not require the use of highly buoyant viscous drag elements; (2) involve an irregular or highly curved surface; or (3) involve spanning a submerged object such as a pipeline. The rigid frame is generally more useful in those applications that require the underwater erosion control system to be maintained in close contact with a smooth bottom contour to prevent scour and applications that require using highly buoyant viscous drag elements to build a submerged breakwater, as is often required for control of coastal shoreline erosion.

Flexible Frame

Figure 1:
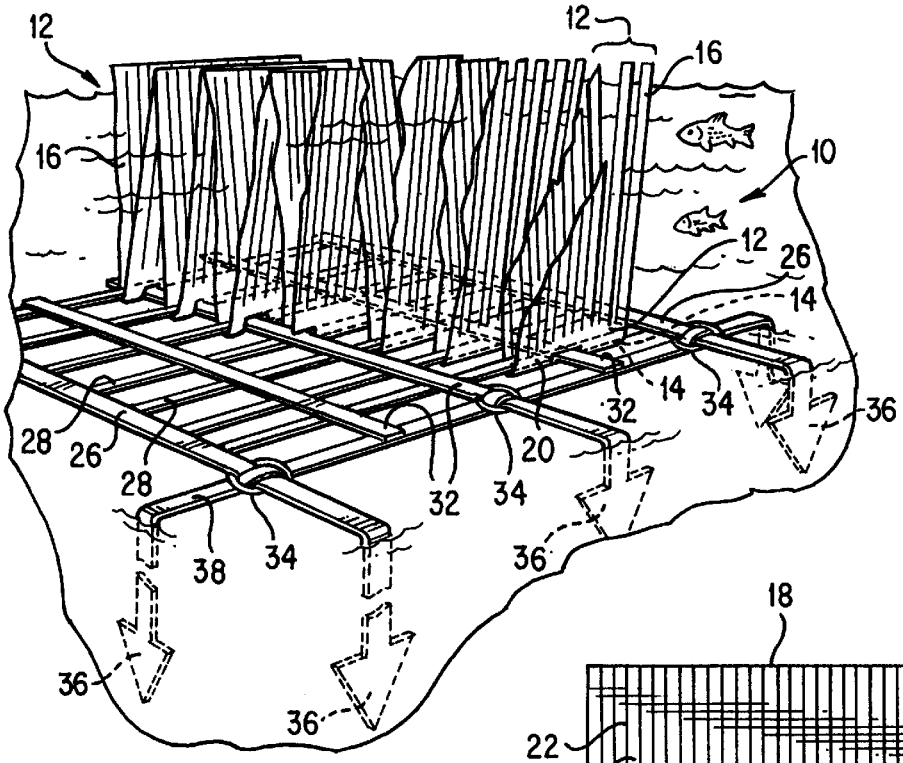
FIG. 1 is a perspective view of a portion of an underwater erosion control system with a flexible frame in accordance with the present invention.
Figure 2:
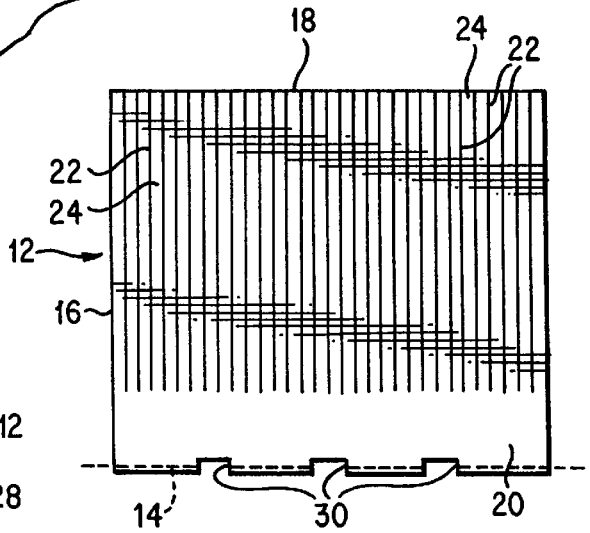
FIG. 2 is a front elevational view of a panel used as a viscous drag element of an underwater erosion control system in accordance with the present invention.

Referring first to FIG. 1, there is shown an underwater erosion control system 10 in accordance with the flexible frame embodiment of the present invention. System 10 includes an array of panels 12. Panels 12 have a retaining portion 20 intermediate two sheets 16. Panels 12 are generally folded or bent about center lines 14. Each center line 14 defines the median of retaining portion 20. Center lines 14 are generally perpendicular to the longitudinal axis of the underwater soil erosion control system 10. As most clearly seen in FIG. 2, sheets 16 have a top edge 18 that is free and unattached. Panels 12 with slitted sheets 16 function as viscous drag elements for increasing viscous drag and non-laminar flow on the moving water.

Panel 12 can be of any length and width desired to create an underwater erosion control system of any height and width. The length of system 10 is defined by the number of panels 12 and the spacing between panels 12. Considerations concerning materials availability, manufacturing and deployment may affect the desired dimensions of system 10. A preferred size of system 10 for purposes of manufacturing and deployment is about 60"×90" by about 54" high, with each panel 12 spaced between 1" to 6" apart from each successive panel 12. To provide a system that is wider, additional units of system 10 are installed adjacent to one another, i.e., side-by-side. Further, in addition to a system comprising multiple units set side-by-side, multiple units can be placed in front of or behind other units to extend the area of coverage.

Returning now to FIG. 2, there is shown a front portion of panel 12 separated from its frame. The back portion is a mirror image of the front portion. Sheet 16 contains a plurality of slits 22 preferably spaced about 2.54 cm (1") apart. Slits 22 define strips 24, which extend from top edge 18 down to retaining portion 20. Preferably, retaining portion 20 is sized to reduce the susceptibility of slits 22 extending through to apertures 30. Slits 22 are preferably perpendicular to center line 14 (and therefore are also preferably perpendicular to top edge 18). As an example, for a system 10 on a sheet 16 measuring about 54" tall, slits 22 may be about 51" long, ending to about 3" from center line 14. At least one, and preferably three, apertures 30 are provided in retaining portion 20 of panel 12 along center line 14.

Further details regarding panels 12 and other suitable viscous drag element arrangements are disclosed in U.S. patent application Ser. No. 08/672,973, entitled "Viscous Drag and Non-Laminar Flow Component of Underwater Erosion Control System," filed concurrently herewith and assigned to the same assignee as the present application, the disclosure of which is hereby incorporated by reference.

Referring again to FIG. 1, a flexible frame is provided for securing panels 12 in relationship to each other and to the seabed or riverbed. Two longitudinal supports 26 extend along the length of the underwater erosion control system 10 near its bottom portion. Preferably, longitudinal supports 26 extend just exterior to the outer edges of panels 12. Several flexible rungs 28 traverse longitudinal supports 26. Rungs 28 are attached at both ends to longitudinal supports 26. Preferably, rungs 28 are sewn to longitudinal supports 26, but other known attachment means such as rivets may be used. Rungs 28 are uniformly spaced along the longitudinal axis of the underwater erosion control system 10, preferably at a 1" to 6 spacing. The placement and orientation of rungs 28 define the distance between panels 12 and their relationship to each other.

Rungs 28 overlie center lines 14 of panels 12 and define the lower edge of apertures 30. Inner supports 32 extend generally parallel to longitudinal supports 26. Inner supports 32 are threaded through apertures 30 of successive panels 12. This arrangement restricts movement of sheets 16 in a direction transverse to the longitudinal axis of system 10.

Longitudinal supports 26 terminate at anchors 36. Inner supports 32 also may terminate at an anchor 36. Longitudinal supports 26 and inner supports 32 attach to a transverse secondary support 38, preferably by rivets, but stitching or other known attaching means also may be used. Each end of transverse secondary support 38 terminates at an anchor 36. Rings 34 are provided to prevent the rivets used in attaching longitudinal supports 26 to inner supports 32 from being rotated and torn out.

Longitudinal supports 26, transverse secondary supports 38 and inner supports 32 may be made of any suitable material, and are preferably made of polyester webbing having adequate tensile strength to prevent tearing. Rungs 28 also may be made of any suitable material, and preferably are made of woven polyester fiber bands.

Figure 3:
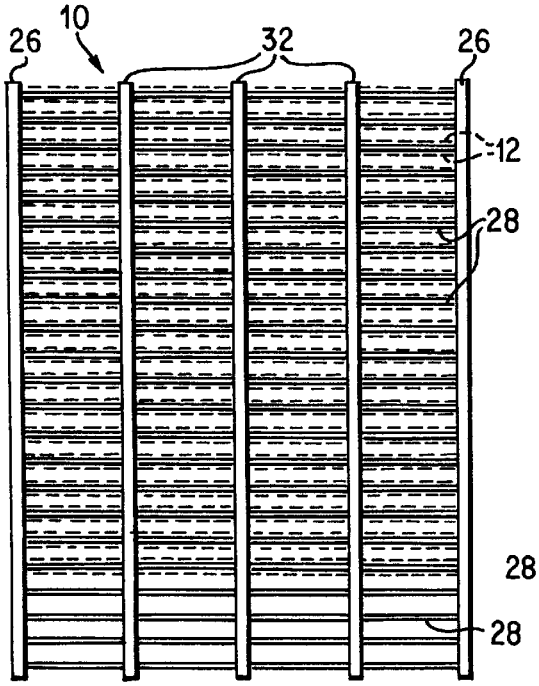
FIG. 3 is a top plan view of a portion of an underwater erosion control system having a flexible frame in accordance with the present invention.

FIG. 3 is a top plan view of a portion of system 10 in accordance with the present invention. FIG. 3 depicts the relationship of panels 12 to rungs 28 and the attachment of rungs 28 to longitudinal supports 26. For clarity, not all of the panels 12 are shown. Rungs 28 are generally parallel, individual segments of strap or rope. However, the parallel relationship of rungs 28 may vary under water because the elements of system 10 are generally flexible.

Figure 4:
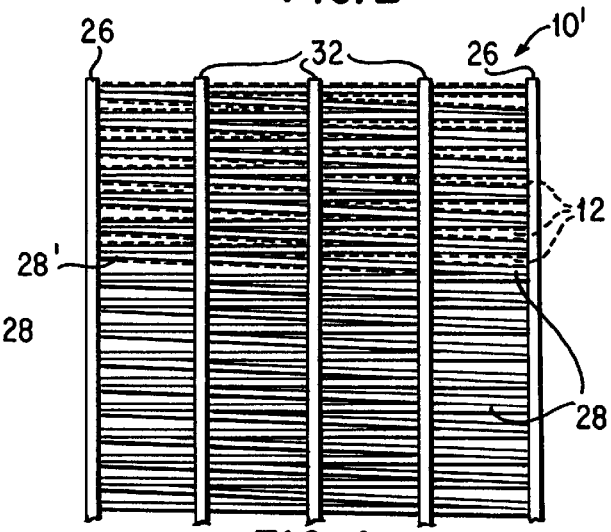
FIG. 4 is a top plan view of a portion of an alternative underwater erosion control system with a flexible frame in accordance with the present invention.

FIG. 4 is a top plan view of a portion of an alternative system 10' having rungs 28' that are formed by one continuous rope or strap that traverses back and forth between longitudinal supports 26 to form a zigzag or "Z" configuration. Once again, not all of the panels 12 are shown. In the embodiment shown in FIG. 4, alternating rungs 28' are generally parallel and alternating panels 12 are generally parallel. However, successive rungs 28' are not parallel and successive panels 12 are not parallel. Rungs 28 of FIG. 3 and rungs 28' of FIG. 4 are uniformly spaced to maintain uniformity of viscous drag throughout the cross section of underwater erosion control systems 10 and 10', respectively.

System 10 is installed on the sea floor by securing a net over panels 12 and having divers transport system 10 to the sea floor. Anchors 36 are driven into the ground using a suitable driving tool. The divers then remove the net from panels 12 and the system is deployed and operational.

Rigid Frame

Figure 5:
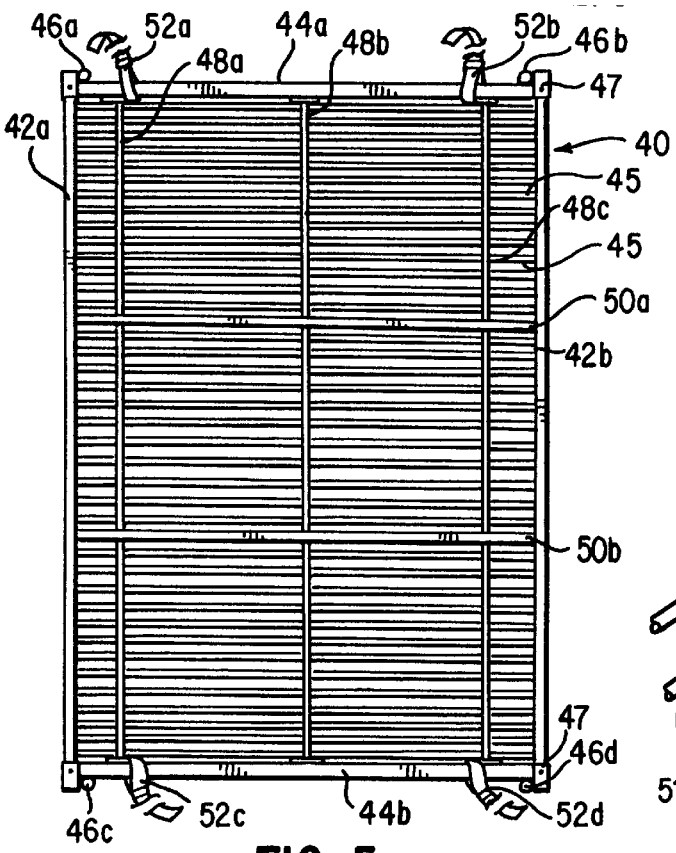
FIG. 5 is a top plan view of a rigid frame in accordance with the present invention.

Referring now to FIG. 5, there is shown a rigid frame embodiment of the present invention. Rigid frame 40 includes two opposed longitudinal supports 42*a,b* and two opposed end supports 44*a,b*. Longitudinal supports 42*a,b* are preferably 7.5 feet long and made of 1.5"×1.5" cold-rolled steel. Holes formed in longitudinal supports 42*a,b* receive and retain a plurality of rungs 45. However, any suitable means for attaching rungs 45 to longitudinal supports 42 *a, b* may be used. A preferred embodiment includes forty-five rungs 45. Rungs 45 preferably are made of 0.625 inch carbon steel tubing.

End supports 44*a,b* are preferably about 5 feet long and are made of 2"×2" cold-rolled steel. The ends of longitudinal supports 42*a,b* fit into end supports 44*a,b* and are attached via bolts 47. End supports 44*a,b* include chain guides 46*a–d* for receiving an anchor chain as described below. Chain guides 46*a–d* preferably are made of 1.75" cold-rolled steel pipe.

Four attachment straps 52*a–d* are placed around end supports 44*a,b* prior to the attachment of longitudinal supports 42*a,b* to end supports 44*a,b*. Attachment straps 52*a–d* are used to attach rigid frame 40 to an installation frame as described below. Attachment straps 52*a–d* preferably are made of 1.5" polyester webbing.

Figure 6:
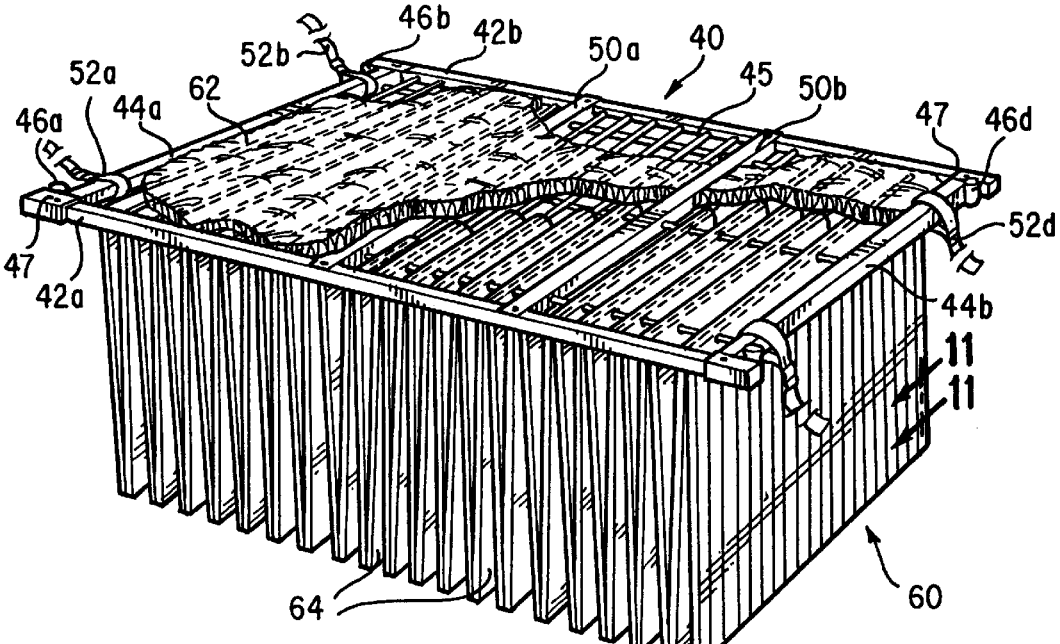
FIG. 6 is a perspective view of an underwater erosion control system that includes the rigid frame of FIG. 5 as it is oriented during its assembly.

Rigid frame 40 also includes inner supports 48*a–c* bounded by end supports 44*a,b*. Inner supports 48*a–c* are positioned above rungs 45 to keep rungs 45 from flexing and to provide a positive means of preventing lateral movement of the panels 64 as the inner supports pass through the apertures in the retaining portion of the panels, as shown in FIG. 6. Although the preferred embodiment includes three inner supports 48*a–c*, more or fewer may be used in a given application. Inner supports 48*a* and 48*c* are each positioned 6", in from one of longitudinal supports 42*a,b*. Inner support 48*b* is centrally located between longitudinal supports 42*a,b*.

Finally, rigid frame 40 includes two supports 50*a* and 50*b* for inner supports 48*a–c*. Supports 50*a* and 50*b* are "L" shaped metal or other suitable material, to provide a rigid support. Supports 50*a, b* are located between two successive rungs 45. In a preferred embodiment having forty-five rungs 45, support 50*a* is placed between the fifteenth and sixteenth rungs 45 and support 50*b* is placed between the thirtieth and thirty-first rungs 45. The supports 50*a* and 50*b* are attached to longitudinal supports 42*a* and 42*b*.

Figure 5A:
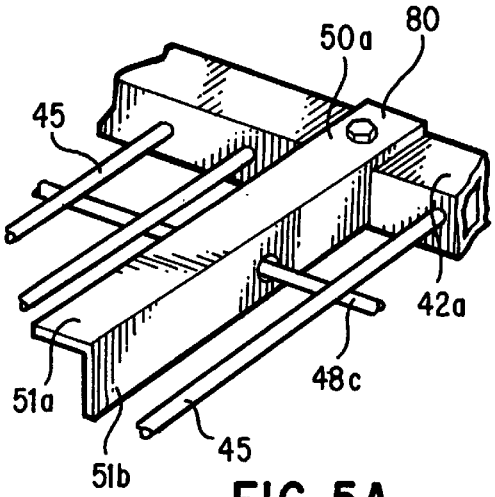
FIG. 5A is a perspective view of a portion of the underside of a rigid frame in accordance with the present invention.

FIG. 5A is a perspective view of the underside of a portion of rigid frame 40, showing in more detail support 50*a*. Support 50*a* has two portions 51*a* and 51*b*, which extend at right angles to each other. Portion 51*a* is preferably 1½ and portion 51*b* is preferably 2". Apertures are formed in portion 51*b* for receiving inner supports, such as inner supports 48*a–c*. Portion 51*a* has extended flaps 80 that extend beyond portion 51*b* for bolting support 50 to the longitudinal supports 42*a* and 42*b*.

FIG. 6 shows an underwater erosion control system 60 that includes rigid frame 40 of FIG. 5. In FIG. 6, system 60 is oriented upside down from its final installed orientation. However, system 60 is assembled in the orientation shown in FIG. 6. In addition to rigid frame 40, system 60 includes bottom fill material 62 and panels 64, which are similar in construction to panels 12 of system 10. Bottom fill material 62 comprises a 1" thick layer of geotextile polyethylene pad and is used to provide positive contact between system 60 and the sea floor when system 60 is installed. Bottom fill material 62 is held in place using heavy duty tie wraps or other suitable means (not shown).

Figure 7:
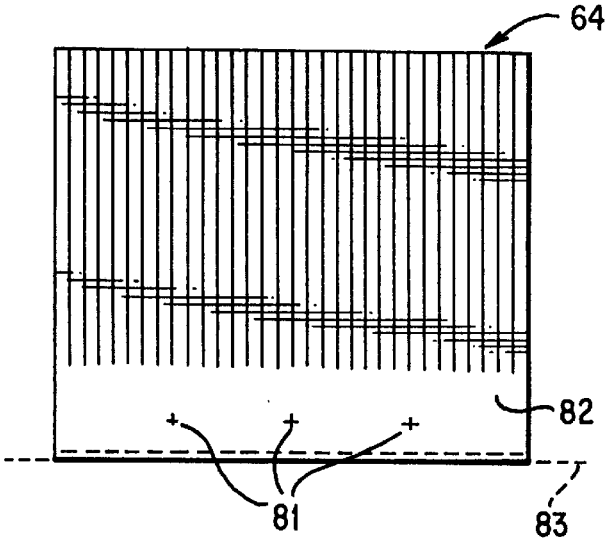
FIG. 7 is a front elevational view of a panel used in the underwater erosion control system shown in FIG. 6.

FIG. 7 is a front elevational view of panel 64 shown separated from its frame. The back view of panel 64 is a mirror image of the front view. Panel 64 is similar to panel 12, shown in FIG. 2. However, apertures 81 are formed within retaining portion 82 of panel 64 spaced some distance above center line 83 rather than on the center line as in panels 12. Apertures 81 are positioned to receive inner supports 48*a–c* to provide a positive means for preventing lateral movement of panels 64. Panels 64 are preferably 60" wide and 54" tall.

Figure 8:
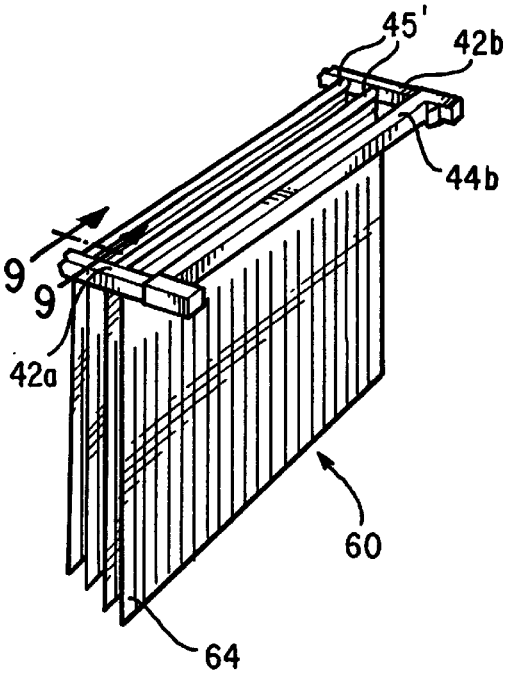
FIG. 8 is a perspective view of an alternative arrangement of the underwater erosion control system shown in FIG. 6.
Figure 9:
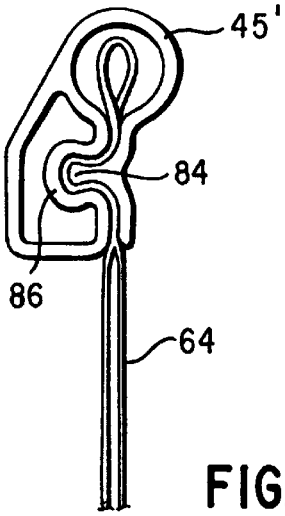
FIG. 9 is a cross-sectional view taken along line 9—9 in FIG. 8 showing a clamping arrangement for securing viscous drag elements to an underwater erosion control system.
Figure 10:
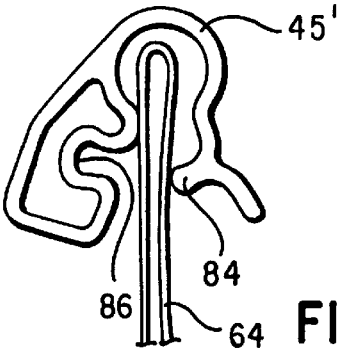
FIG. 10 is a sectional view similar to FIG. 9, showing the clamping arrangement open.

Panels 64 are folded or bent along center line 83 of retaining portion 82 as shown in FIG. 6, with inner supports 48*a–c* inserted through apertures 81 for holding panels 64 in relation to rungs 45. An alternative clamping arrangement for holding panels 64 in relation to the rungs is shown in FIGS. 8–10. FIG. 8 shows a perspective view of system 60, oriented as in FIG. 6, using the alternative clamping arrangement. FIG. 9 shows a cross-sectional view taken along line 9–9 in FIG. 8. FIG. 10 is a cross-sectional view similar to FIG. 9, except FIG. 10 shows clamping rung 45' in an open position. FIG. 9 shows clamping rung 45' in a closed position with panel 64 retained therein. As best seen in FIGS. 9 and 10, clamping rung 45' has a protrusion 84 that is releasably fixed within clamping portion 86, which is adapted to receive and releasably retain protrusion 84. Preferably, rung 45" is made of a co-polymer.

Figure 11:
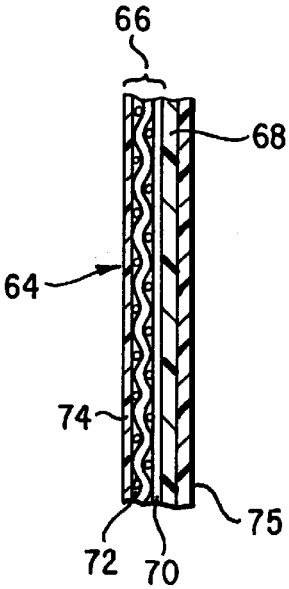
FIG. 11 is a sectional view taken along line 11—11 of FIG. 6 showing a portion of a panel used as a viscous drag element in accordance with the present invention.

FIG. 11 is a sectional view showing the materials that form panels 64. Panels 64 are described in the above-referenced copending application entitled "Viscous Drag and Non-Laminar Flow Component of Underwater Erosion Control System." Panels 64 are composed of a backing 66 and a layer of foam 68. Backing 66 and foam 68 are combined by lamination 70, which provides a consistent bond between backing 66 and foam 68. Backing 66 is preferably formed from a woven polymer 72 with one coat 74 of a polymer on the side that is not laminated. The coating 74 preferably contains commonly known ultraviolet stabilizing agents to protect backing 66. Alternatively, woven polymer 72 may be coated on both sides with a polymer prior to lamination. Preferably, backing 66 is formed from a woven polyethylene coated on one side with polyethylene and stabilized against ultraviolet radiation. Alternatively, backing 66 is formed from a woven polypropylene coated on one side with polypropylene and stabilized against ultraviolet radiation. The preferred backing 66 has a tensile strength in excess of 100 pounds in both warp and weft as measured by ASTM D751 Method A. More preferably, backing 66 has a tensile strength of 200 pounds in warp and weft as measured by ASTM D751 Method A. The strength of backing 66 should be maintained after backing 66 is laminated to foam 68. Preferably, foam 68 is 100% closed cell polyethylene having a density in excess of 1 pound per cubic foot, and more preferably having a density between 1.2 and 1.4 pounds per cubic foot. An additional coating 75 of a polymer, such as polyethylene, may be added to the side of foam 68 that is not laminated. Preferably, coating 75 exceeds 1.0 mils in thickness. The preferred thickness for sheet 64 is 0.08 to 0.12 inches. When folded for deployment, coating 75 is preferably folded to form an interior side of sheet 64, while backing 66 and coating 74 forms the exterior side of sheet 64.

Method of Installation

Figure 12:
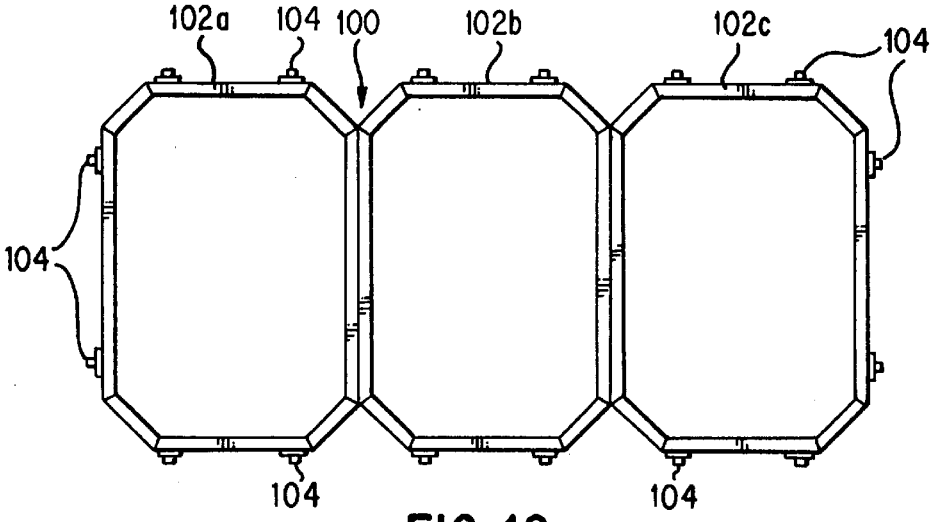
FIG. 12 is a top plan view of three base frame modules for use in the method of the present invention.
Figure 13:
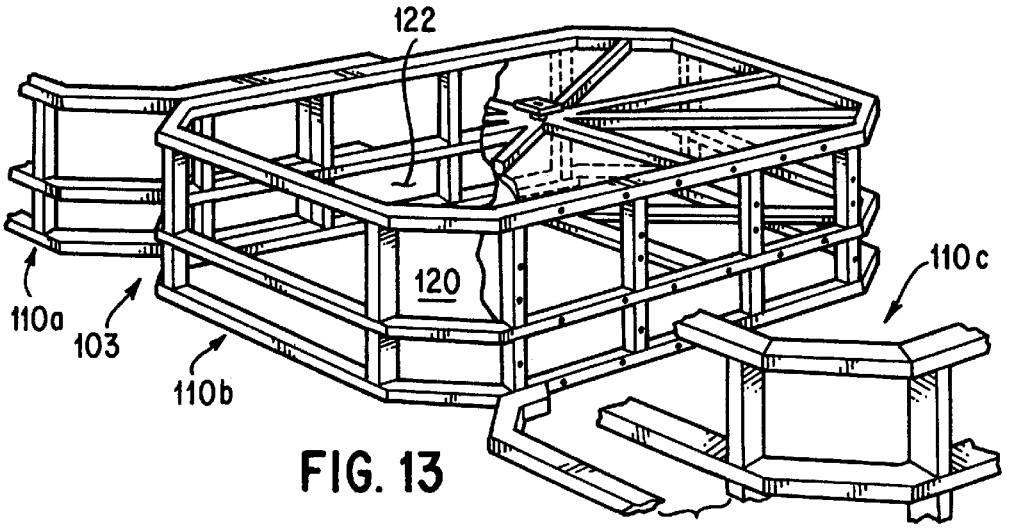
FIG. 13 is a perspective view of an installation frame for use in the method of the present invention.

Installing system 60 requires two additional components—a base frame 100 as shown in FIG. 12 and an installation frame 108 as shown in FIG. 13. Base frame 100 is fixedly attached to the deck of the vessel that is used in installing system 60 on the sea floor. Base frame 100 is used to align three rigid frames 40 for attachment to installation frame 108. In the preferred method of installation, base frame 100 includes three base frame modules 102*a–c*, each of which receives a single rigid frame 40.

Base frame modules 102*a–c* include a plurality of guide tubes 104 for aiding placement of rigid frames 40 and installation frame 108 on base frame 100. Guide tubes 104 are preferably 8" tall. Guide tubes 104 optionally hold poles to increase the height of this guidance system. The perimeters of rigid frames 40 and installation frame 108 are aligned interior to guide tubes 104 and any associated poles for placement on base frame 100. Base frame modules 102*a–c* are made of 2"×2" cold-rolled steel welded together at 135° angles at each junction.

Figure 14:
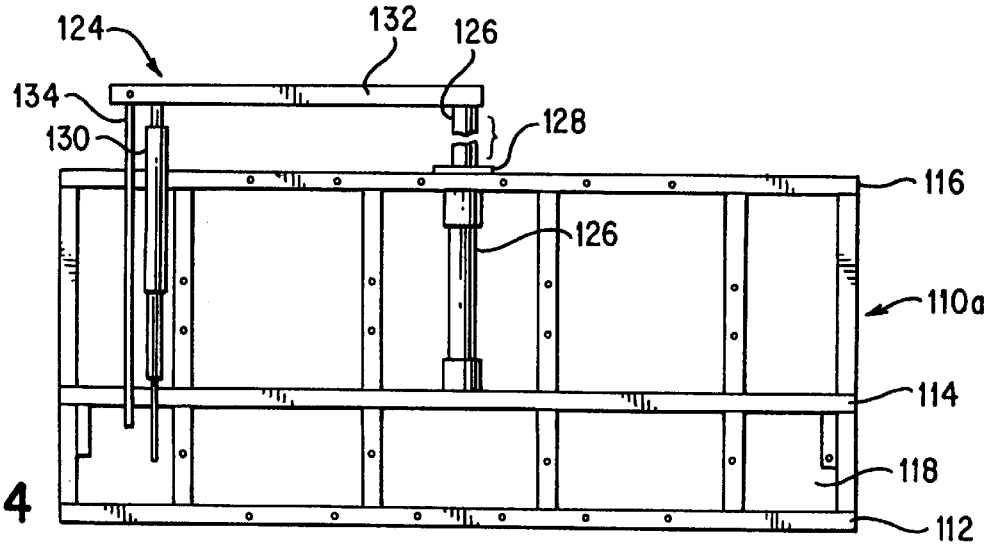
FIG. 14 is a side elevational view of an installation frame module for use in installing a rigid mat system of the present invention.

Turning now to FIG. 13, there is shown an installation frame 108. In the preferred method of installation, installation frame 108 includes three installation frame modules 110*a–c* that correspond to the three base frame modules 102*a–c*. FIG. 14 shows installation frame module 110*a*, which is representative of installation frame modules 110*a–c*. Installation frame module 110*a* generally comprises a first level 112, a second level 114 above the first level 112, and a third level 116 above the second level 114. The perimeters of levels 112, 114 and 116 are made of 2"×2" cold-rolled steel welded together at 135° angles. Vertical supports made of 2"×2" box beam attach levels 112, 114 and 116 together. In the preferred embodiment, installation frame module 110*a* is 42" tall.

First level 112 contacts rigid frame 40 when installation frame module 110*a* is placed on top of rigid frame 40. First level 112 and second level 114 define a cavity 118 for retaining panels 64 during the installation process.

Second level 114 supports second level deck 120 as seen in FIG. 13. Second level deck 120 holds additional ballast, as needed, to reduce positive buoyancy during the underwater installation process. Second level deck 120 preferably is made of a 1" thick extruded fiberglass grating material. A plurality of conventional ratchet devices (not shown) are mounted on the perimeter of second level 114 for receiving attachment straps 52*a–d*.

Third level 116 supports third level deck 122 as seen in FIG. 13. Deck 122 preferably is made of a 1" thick extruded fiberglass grating material. Deck 122 is a working level on which one diver works during the installation process. Deck 122 of installation module 110*a* also supports an anchor setting and tensioning hoist 124. Hoist 124 is used to tension the anchor assembly as described below. Hoist 124 generally includes a 3.5" central tube or mast 126, a plate 128, a 4-ton capable hydraulic jack 130, a rigid beam 132 and a tensioning chain 134. Mast 126 extends down to second level deck 120.

The installation process begins on a vessel having base frame modules 102*a–c* fixedly attached to its deck. Three rigid systems 60 are manually lifted to place them on base frame modules 102*a–c*. A net may be secured to rigid frame 40 to contain panels 64 of systems 60. Guide tubes 104 facilitate the process of aligning and placing systems 60 on base frame modules 102*a–c*. Next, anchors 138 (see FIG. 15) are laid out on the deck. Each anchor 138 is attached to an anchor assembly 146 that has free ends 148, one of which will be placed in one of chain guides 46*a–d*. The second free end 148 of anchor assembly 146 will be attached in the adjacent chain guide to any adjacent rigid frame. The anchor assemblies 146 that are placed in the outside chain guides of the system only have one free end 148 because there is no adjacent chain guide. Anchor assembly 146 is bolted in the chain guides with about the last one foot of its free ends 148 remaining outside the chain guide.

The vessel's overhead crane is then used to place installation frame 108 over the three systems 60. Guide tubes 104 again facilitate this process. Each rigid frame 40 is then attached to an installation frame module 110*a–c* by attachment straps 52*a–d*. In particular, attachment straps 52*a–d* are inserted into the ratchet devices mounted on second level 114 and tensioned appropriately. Anchor 138 is then hung on third level 116 of installation frame 108 for the descent to the sea floor.

The vessel's crane then lifts installation frame 108 and systems 60, which are now attached to installation frame 108 by attachment straps 52*a–d*, over the side of the vessel and lowers them to the sea floor.

Once system 60 is properly positioned on the sea floor, two divers begin to anchor the system. Generally, one diver works on third level deck 122 of installation frame 108 and the other diver works on the sea floor. Anchors 138 are driven into the sea floor using any suitable means, such as a Stanley BR45 gun. The driving rod for the gun is placed in anchor 138 and the diver on third level deck 122 begins driving anchor 138 into the sea floor. When the driving device is too low for this diver to operate, the diver on the sea floor takes over and finishes driving anchor 138 into the sea floor. Anchor 138 is preferably driven to a depth of more than four feet, depending on conditions and anchor types.

After anchor 138 is driven into the sea floor, the bolt holding the free end 148 of the anchor assembly 146 in the chain guide is released and free end 148 of anchor assembly 146 is attached to tensioning chain 134 of the anchor setting and tensioning hoist 124 mounted on deck 122. Hoist 124 is used to tension anchor assembly 146 to approximately 1,500 pounds and the bolt is then reinserted in the chain guide to maintain this tension in anchor assembly 146.

Figure 15:
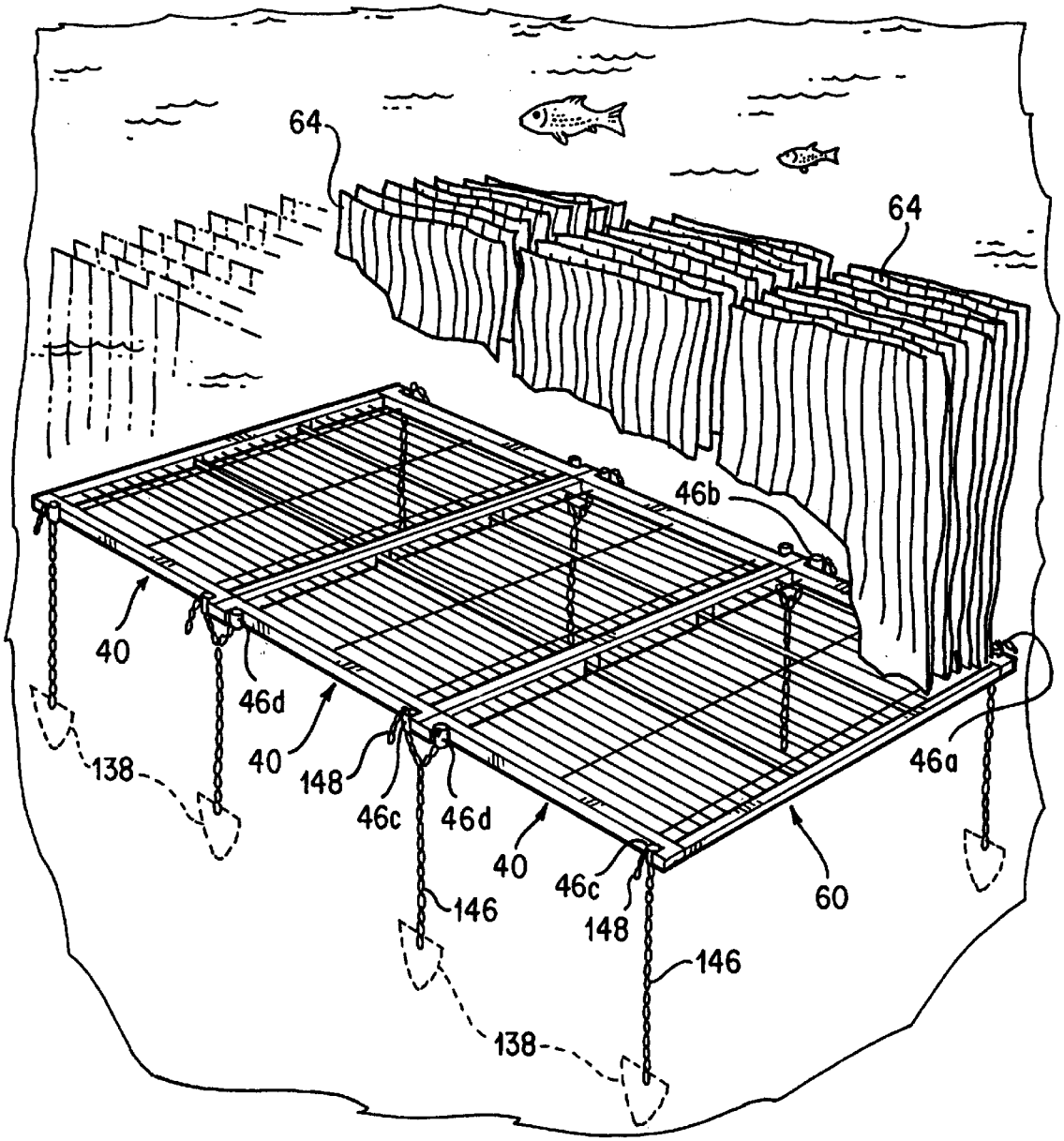
FIG. 15 is a perspective view of an installed underwater erosion control system having a rigid frame.

After anchors 138 have been driven into the ground and properly tensioned, installation frame 108 is removed from rigid frame 40. This is done by releasing the tension on the rachet devices so that attachment straps 52*a–d* are released. Alternatively, attachment straps 52*a–d* may be expendable and are cut by the divers. After attachment straps 52*a–d* are released, the vessel's overhead crane removes installation frame 108 while leaving system 60 securely anchored into the sea floor, as shown in FIG. 15. Finally, if a net was used, the divers remove the net.

The system described herein has a structure that secures the viscous drag elements of an underwater erosion control system in a desired relationship. The structure allows forces from the water current to be uniformly distributed throughout the underwater erosion control system. The system also maintains positive contact with the sea floor.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. An underwater erosion control system comprising:

two longitudinal supports substantially parallel to each other;

a plurality of viscous drag elements positioned between said longitudinal supports; and a plurality of rungs for securing said viscous drag elements to the underwater erosion control system, said rungs being transverse to, and attached to, said longitudinal supports;

wherein each said viscous drag element has a retaining portion having at least one aperture formed therein and further comprising at least one supplemental support extending substantially parallel to said longitudinal supports and passing through said at least one aperture of each of said viscous drag elements.

2. The system of claim 1 wherein said rungs are discrete and are not directly connected to each other.

3. The system of claim 1 further comprising an inner support that is substantially parallel to said longitudinal supports.

4. The system of claim 1 further comprising an anchoring member for anchoring said longitudinal supports to an underwater surface.

5. The system of claim 1 wherein said longitudinal supports are flexible.

6. The system of claim 1 wherein said longitudinal supports comprise polyester webbing.

7. The system of claim 1 wherein said rungs are flexible.

8. The system of claim 7 wherein said rungs comprise woven polyester fiber band material.

9. The system of claim 1 wherein said longitudinal supports and said rungs are rigid.

10. The system of claim 1 wherein said rungs are substantially perpendicular to said longitudinal supports.

11. The system of claim 1 further comprising a fill material positioned beneath a bottom portion of said system, said fill material occupying space between the bottom portion of said system and an underwater surface.

12. An underwater erosion control system comprising:

two substantially parallel end supports;

a plurality of viscous drag elements;

two longitudinal supports that extend lengthwise along the underwater erosion control system on opposite sides of the plurality of viscous drag elements, said longitudinal supports being substantially parallel to each other and being attached to said end supports to form a substantially rectangular frame;

a plurality of rungs for securing the viscous drag elements to the underwater erosion control system, said rungs being substantially perpendicular to, and retained by, said longitudinal supports; and at least one inner support that is substantially parallel to said longitudinal supports and is positioned over said plurality of rungs.

13. The system of claim 12 further comprising at least one support for the inner support, said at least one support for the inner support being substantially perpendicular to, and attached to, said longitudinal supports.

14. The system of claim 12 wherein said longitudinal supports and said end supports are rigid.

15. The system of claim 14 wherein said longitudinal supports and said end supports are made of cold-rolled steel.

16. The system of claim 12 further comprising a fill material positioned beneath a bottom portion of said frame, said fill material occupying space between the bottom portion of said frame and an underwater surface.

17. An underwater erosion control system comprising:

two substantially parallel end supports;

a plurality of viscous drag elements;

two longitudinal supports that extend lengthwise along the underwater erosion control system on opposite sides of the viscous drag elements, said longitudinal supports being substantially parallel to each other and being attached to said end supports to form a substantially rectangular frame; and a plurality of rungs for securing the plurality of viscous drag elements to the underwater erosion control system, said rungs being substantially perpendicular to, and retained by, said longitudinal supports;

wherein said plurality of rungs are adapted to define an open position and a closed position, wherein when at least one of said plurality of rungs is in the closed position a portion of at least one of said viscous drag elements is retained within said at least one rung.

18. The system of claim 17 wherein said at least one rung has a protrusion and a clamping portion adapted to receive and releasably retain said protrusion.

19. The system of claim 17 further comprising a fill material positioned beneath a bottom portion of said frame, said fill material occupying space between the bottom portion of said frame and an underwater surface.

20. An underwater soil erosion control system comprising:

two substantially parallel end supports;

two longitudinal supports that extend lengthwise along the underwater erosion control system, said longitudinal supports being substantially parallel to each other and being attached to said end supports to form a substantially rectangular frame;

a plurality of viscous drag elements positioned between said longitudinal supports; and;

wherein each said viscous drag element has at least one aperture that is bounded on one side by one of said rungs and further comprising at least one inner support extending substantially parallel to said longitudinal supports and passing through the at least one aperture of each of said viscous drag elements.

21. The system of claim 20 wherein said at least one inner support is positioned over said plurality of rungs.

22. The system of claim 21 further comprising at least one support that supports said inner support and is attached to the longitudinal supports.

23. The system of claim 20 wherein said longitudinal supports and said end supports are rigid.

24. The system of claim 23 wherein said longitudinal supports and said end supports are made of cold-rolled steel.

25. A method for installing an underwater erosion control system, comprising the steps of:

providing a base frame;

placing a rigid mat system having viscous drag elements attached thereto on the base frame;

placing an installation frame on the rigid mat system;

releasably attaching the rigid mat system to the installation frame;

transporting the rigid mat system and the installation frame to the sea floor;

anchoring the rigid mat system to the sea floor; and releasing the installation frame from the rigid mat system.

* * * * *